US005505839A

United States Patent [19]

Suzuki et al.

[11] Patent Number: 5,505,839

[45] Date of Patent: Apr. 9, 1996

[54] METHOD OF COAL LIQUEFACTION

[75] Inventors: Nobuo Suzuki, Kawasaki; Tsuneaki Mochida; Kenji Matsubara, both of Yokohama, all of Japan

[73] Assignee: NKK Corporation, Tokyo, Japan

[21] Appl. No.: 285,507

[22] Filed: Aug. 3, 1994

[30] Foreign Application Priority Data

Aug. 9, 1993 [JP] Japan ..... 5-197501

[51] Int. Cl.[6] ..... C10G 1/00

[52] U.S. Cl. ..... 208/408; 208/400; 208/428; 208/434

[58] Field of Search ..... 208/428, 434, 208/408, 400

[56] References Cited

U.S. PATENT DOCUMENTS

| | | | |
|---|---|---|---|
| 3,983,028 | 9/1976 | McCollum et al. | 208/8 |
| 3,988,238 | 10/1976 | McCollum et al. | 208/8 |
| 4,045,328 | 8/1977 | Green et al. | 208/8 |
| 4,048,054 | 9/1977 | Green et al. | 208/8 |
| 4,158,637 | 6/1974 | Jones | 208/449 R |
| 4,440,622 | 4/1984 | Derbyshire | 208/8 LE |
| 4,447,310 | 5/1984 | Derbyshire | 208/8 LE |
| 4,946,583 | 8/1990 | Wurfel | 208/400 |
| 5,269,910 | 12/1993 | Matsumura | 208/433 |

FOREIGN PATENT DOCUMENTS

| | | |
|---|---|---|
| 511677 | 8/1980 | Australia . |
| 2711105 | 9/1978 | Germany . |

*Primary Examiner*—Helane Myers

*Attorney, Agent, or Firm*—Frishauf, Holtz, Goodman, Langer & Chick

[57] ABSTRACT

A method of coal liquefaction comprising the steps of: (a) producing a coal slurry from a pulverized coal and a solvent; (b) compressing a coke oven gas to prepare a compressed gas; (c) reacting the coal slurry with the compressed gas in a reactor under a high pressure and high temperature condition to form a liquefied product; (d) separating the liquefied product into a used gas and a liquefied slurry; and (e) distillating the liquefied slurry to form a liquefied oil and a solvent refined coal.

15 Claims, 4 Drawing Sheets

METHOD OF COAL LIQUEFACTION

BACKGROUND OF THE INVENTION

1. Field of the Invention

The present invention relates to a method of coal liquefaction.

2. Description of the Prior Art

FIG. 4 shows a schematic flowchart of a conventional method of coal liquefaction. According to the conventional method, a pulverized coal and a coal liquefied oil (solvent) obtained from the distillation step described later are charged into the slurry tank 2, where they are mixed together under agitation to prepare a coal slurry. The coal slurry is pressurized and mixed with a gas (recycle hydrogen gas) consisting mainly of hydrogen which was separated in the gas purifying step described later, and they are introduced into the heating furnace 3. The coal slurry introduced into the heating furnace 3 is pressurized to a pressure of 100 atm or more and heated to a temperature of 400° C. or more, and feed into the coal liquefaction reactor 4. The coal liquefaction reactor 4 conducts a liquefaction reaction under a hydrogen positive pressure and at an elevated temperature.

The product of the liquefaction reaction leaving the reactor 4 enters into the gas separator 6 where the product is separated to a gas and a liquefied slurry containing liquefied oil and non-liquefied matter.

The liquefied slurry contains a substantial amount of ash and non-liquefied matter consisting mainly of unreacted organic residue. Since such non-liquefied matter causes trouble in the succeeding treatment such as distillation, the liquefied slurry is sent to the filter 30 to separate the non-liquefied matter. The liquefied solution free of non-liquefied matter is sent to the distillation unit 8 to be fractionated into light oil and fuel oil, and to recover the liquefied oil. A part of the liquefied oil is charged to the slurry tank 2 as the solvent for preparing the coal slurry. The filter cake separated by the filter 30 is sent to the hydrogen manufacturing facility 31 as the raw material for hydrogen production, and is gasified there.

On the other hand, the gas separated in the gas separator 6 is sent to the gas purification unit 7 for purification. Since the gas consists mainly of hydrogen, the gas is recycled and is added to the coal slurry which is fed to the liquefaction reactor 4. However, the hydrogen that is recycled is not sufficient to carry out the liquefaction reaction, and hydrogen obtained by gasification of the filtrate discharged from the hydrogen manufacturing facility 31 is added to the coal slurry. The hydrogen manufacturing facility 31 consists of many treatment stages including the gasification stage where the filtrate is completely decomposed under the presence of oxygen, the purification stage for purifying the generated decomposed gas, the hydrogen-enriching stage where the CO gas in the generated gas is shift-reacted to yield a hydrogen-rich gas, the gas cooling stage, and the stage for $CO_2$ removal from the gas, using alkali. In this manner, the hydrogen manufacturing facility is very complex.

According to the above-described method, the liquefaction reaction has to use hydrogen which is produced in an extremely complex hydrogen manufacturing facility 31. Since the hydrogen manufacturing facility 31 is very complex, it is expensive (as high as nearly 40% of the total investment of the liquefaction plant, in some cases), as well as involving a high operating cost. Therefore, the share of hydrogen manufacturing cost to the total coal liquefaction product cost becomes very high.

SUMMARY OF THE INVENTION

It is an object of the present invention to provide a method of coal liquefaction which significantly reduces the cost of coal liquefied products.

To achieve the object, the present invention provides a method of coal liquefaction comprising the steps of:

(a) preparing a coal slurry from a pulverized coal and a solvent;

(b) compressing a gas containing hydrogen to prepare a compressed gas, the gas containing hydrogen being a coke oven gas which is generated during a carbonization of coal in a coke oven;

(c) reacting the coal slurry with the compressed gas in a reactor under a high pressure and high temperature to form a liquefied product;

(d) separating the liquefied product into a used gas and a liquefied slurry; and (e) distillating the liquefied slurry to obtain a liquefied oil and a solvent refined coal.

DESCRIPTION OF THE PREFERRED EMBODIMENT

Based on a series of extensive investigations and experiments, the inventors found that the liquefaction reaction satisfactorily proceeds even if a coke oven gas is used as the hydrogen source. Coke oven gas is a gas which is generated during carbonizing a coal in a coke oven. The coke oven gas contains hydrogen and methane as main components. The coke oven gas is hereinafter referred to simply as "COG". Accordingly, this invention uses COG as the hydrogen source and, after completing the liquefaction reaction, the used COG is returned to the COG supply system instead of recycling the COG. In this case, the used COG under a high pressure is introduced to the gas expander to recover the high pressure energy for the utilizing it as the compression power source of COG being supplied for liquefaction reaction. The energy recovery allows a significant reduction of the power supply for COG compression.

Since the temperature of the liquefied product leaving from the reactor is as high as 400° C. or more, the process of this invention provides a step of recovering the heat of the liquefied product and a step of preheating the coal slurry using the recovered heat for reducing the supply of heat.

Furthermore, a pre-treatment of coal is conducted to reduce ash content. The ash removal prevents accumulation and adhesion of ash in process facilities, and reduces trouble during on operation caused from the ash accumulation and adhesion. The pre-treatment of coal is what is called the oil agglomeration method. According to the oil agglomeration method, a coal-water slurry is prepared either by adding water to a pulverized coal or by pulverizing a coal after adding water to it. When the coal-water slurry is mixed with an oil (liquefied oil), the coal components and the oil bind together to form pellets, which pellets are then separated from aqueous phase. Ash in the coal remains in the aqueous phase. Consequently, a mixture consisting mainly of coal components and oily components is separated from a mixture consisting mainly of ash and water. In this simple manner, ash is removed from coal.

Figure 1:
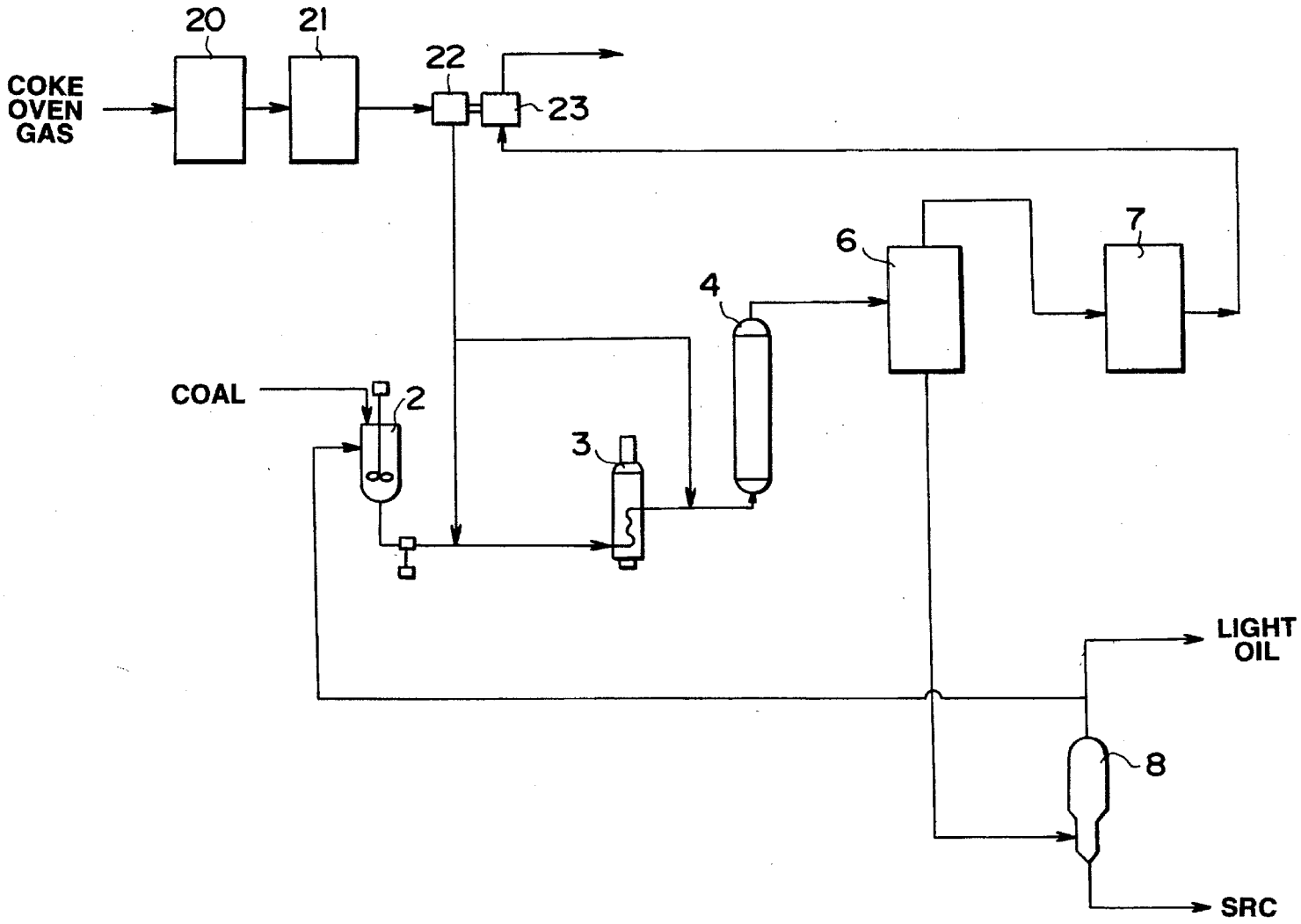
FIG. 1 is a schematic flowchart of an embodiment of the present invention.
Figure 4:
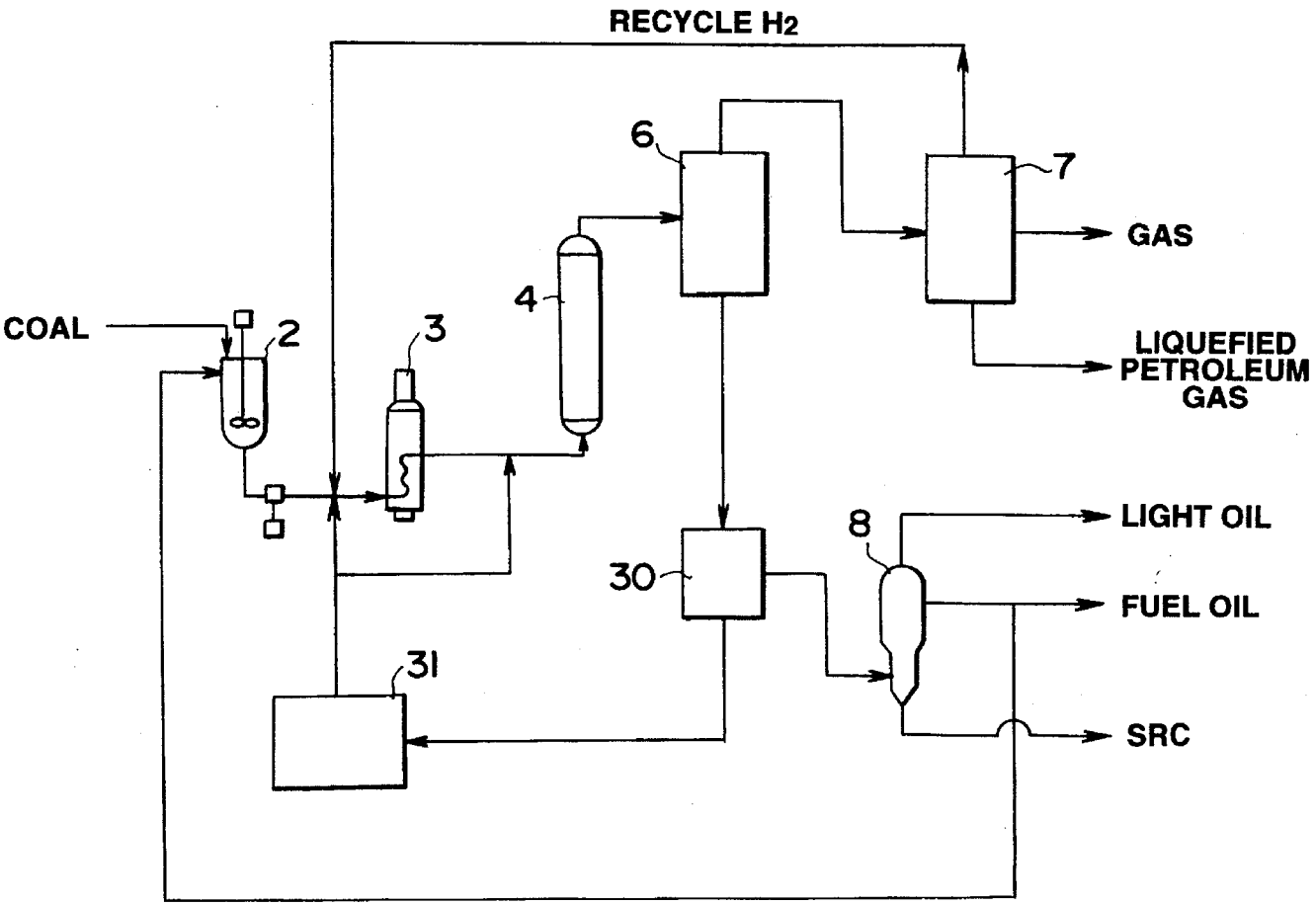
FIG.4 PRIOR ART
FIG. 4 is a schematic flowchart of a conventional coal liquefaction process.

FIG. 1 illustrates an embodiment of this invention. The same functional units and equipment with those in FIG. 4 have the same reference number in both figures, and their description is not given. According to the example, COG is supplied as the hydrogen source for conducting liquefaction reaction. COG supplied from the COG supply system is introduced to the methane converter 20, then to the shift reactor 21, where COG is modified to a hydrogen-rich gas. The modification of COG is performed by the following procedure.

In the methane converter 20 as the first stage, both COG which was desulfurized in advance and steam are introduced, and the reaction between them is conducted at approximately 850° C. and under approximately 20 atm, and in the presence of a catalyst, (equation (1)), where the methane in COG is converted to hydrogen and carbon monoxide. This reaction increases the hydrogen concentration in COG.

$$CH_4+H_2O=3H_2+CO \quad (1)$$

The gas after the reaction is sent to a waste heat boiler (not shown) where the gas is cooled to approximately 400° C.

In the shift reactor 21 as the second stage, the gas reacted in the first stage and cooled in the waste heat boiler is introduced, and the reaction, equation (2), is conducted under the presence of a catalyst.

$$CO+H_2O=H_2+CO_2 \quad (2)$$

The gas generated from the second reaction is cooled near to room temperature to remove moisture.

Since the above-described reactions increase the hydrogen content of the gas, the required amount of COG to supply to the liquefaction reaction is reduced, and the COG compression power is reduced. The modified COG is compressed by the compressor 22, and is added to the coal slurry pumped out from the slurry tank 22.

The coal slurry containing COG is adjusted to the pressure of 100 atm and the temperature of 400° C. or more in the heating furnace 3, then the slurry is fed to the reactor 4. In the reactor 4, the liquefaction reaction is carried out to convert the coal slurry into gas and liquefied slurry which is a mixture of liquefied oil and non-liquefied matter. The liquefied products are fed to the gas separator 6.

In the gas separator 6, the liquefied product is separated to the used COG and the liquefied slurry. The liquefied slurry is then fed to the distillation unit 8 without being filtered and at a state containing ash. A part of the liquefied oil distilled from the distillation unit 8 is recycled to the slurry tank 2, and the rest of the liquefied oil distillate is recovered as light oil. The residue containing ash is recovered as the product consisting mainly of solvent refined coal (SRC), which residue is useful as a caking additive for producing high quality coke or the like.

The used COG separated at the gas separator 6 is purified in the gas purification unit 7, and is withdrawn to the outside of the system without recycling to the reaction system. The withdrawn used COG has a pressure of 100 atm, so it is introduced to the gas expander 23 connected to the compressor 22 to drive it. The used COG discharged from the gas expander 23 is reduced in pressure near to atmospheric pressure, returned to the COG supply system, and used in a common applications such as fuel gas and raw material for chemicals.

This example deals with the case of supplying COG which was modified to a hydrogen-rich state as the hydrogen source. Nevertheless, this invention does not necessarily require this type of modification, and ordinary COG may be supplied directly.

As described above, since this example supplies COG as the hydrogen source, hydrogen production is not necessary, and no hydrogen production facility to gasify the unreacted residue is needed.

Figure 2:
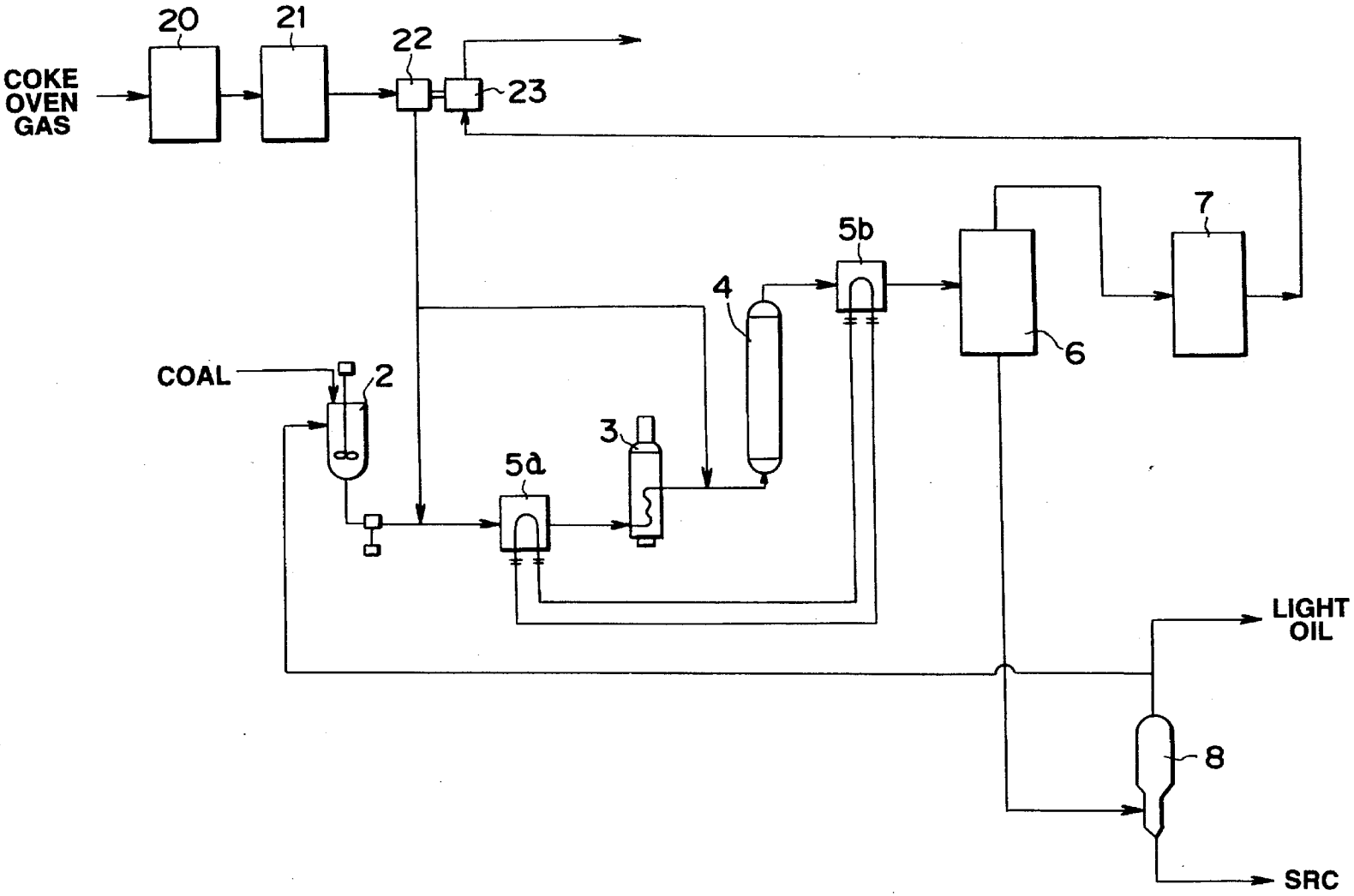
FIG. 2 is a schematic flowchart of another embodiment of the present invention.

FIG. 2 illustrates another embodiment of this invention. The same functional units and equipment with those in FIG. 1 have the same reference number in both figures, and their description is not given. According to the embodiment, the coal slurry being fed to the heating furnace 3 is preheated by the recovered heat of the reaction system. To do this, a heat exchanger **5*a* for preheating and a heat exchanger 5*b* for heat recovery are installed upstream of the heating furnace 3 and the downstream of liquefaction reactor 4**, respectively.

The coal slurry withdrawn from the slurry tank 2 is preheated by the heat exchanger **5*a* and is fed to the heating furnace 3, then to the liquefaction reactor 4. The temperature of reaction product discharged from the liquefaction reactor 4 is 400° C. or more. The reaction product is passed through the heat exchanger 5*b* to perform the heat recovery, then the product is sent to the gas separator 6**.

A circuit for recycling an organic heating medium is located between the heat exchanger **5*a* and the heat exchanger 5*b*. The heating medium which was heated by the reaction product having a high temperature in the heat exchanger 5*b* is sent to the heat exchanger 5*a* where the heating medium heats the coal slurry sent from the slurry tank 2**.

Figure 3:
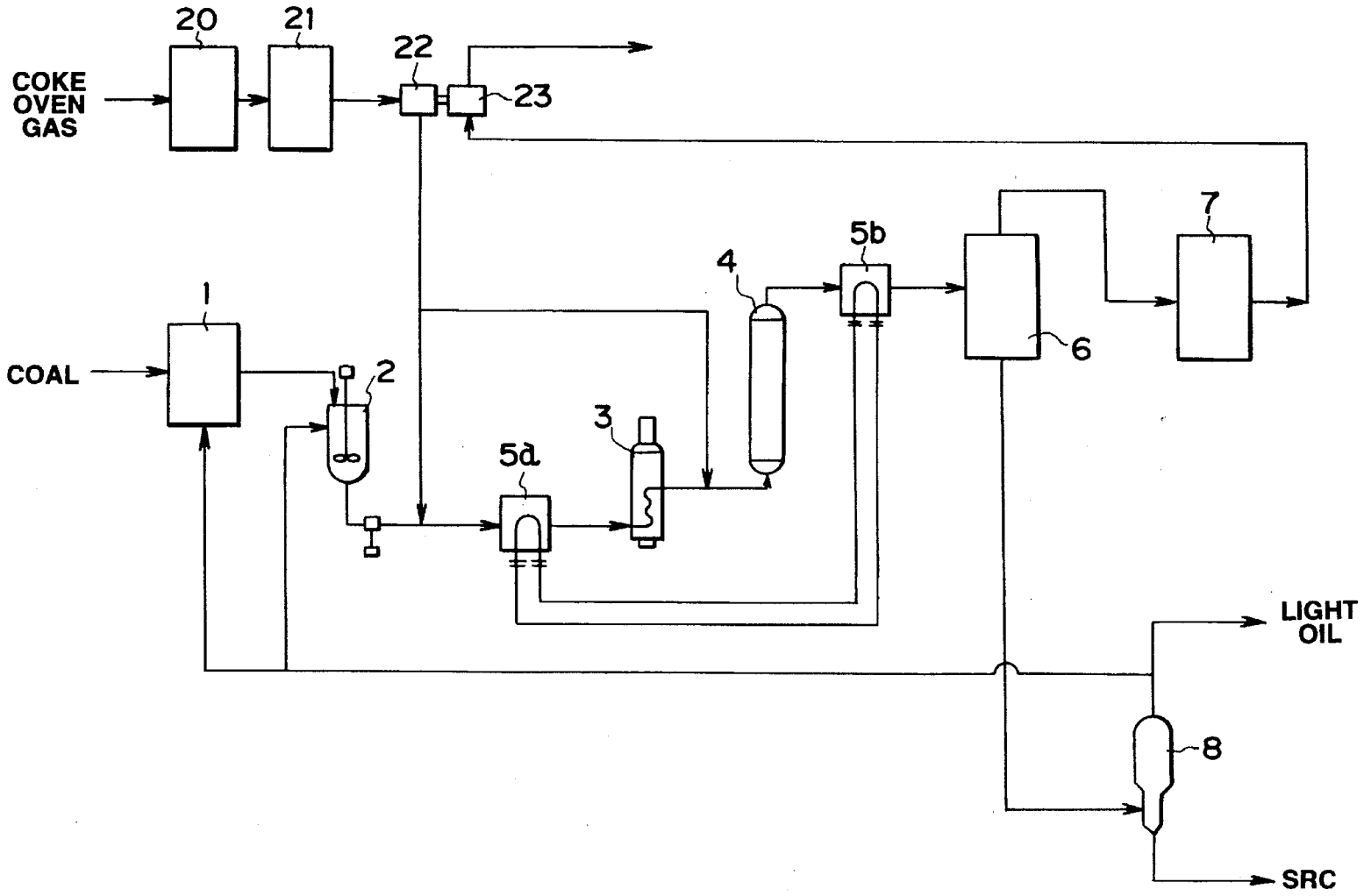
FIG. 3 is a schematic flowchart of further embodiment of the present invention.

FIG. 3 illustrates further embodiment of this invention. The same functional units and equipment with those in FIG. 1 and FIG. 2 have the same reference number in both figures, and their description is not given. According to the embodiment, a pre-treatment of coal is conducted to eliminate ash in the coal. To do this, the ash separator 1 is installed upstream of the slurry tank 2, which prepares the coal slurry.

In the ash separator 1, water is added to the pulverized coal to prepare a coal-water slurry. Then, the liquefied oil obtained from the distillation unit 8 is mixed with the slurry. The liquefied oil mixing induces the binding of coal components in coal into the liquefied oil to form a mixture a pellet shape. The pellet shaped mixture is separated by sieving, and is sent to the slurry tank 2. The ash components remain in the slurry and are removed at the sieving treatment.

In the slurry tank 2, the liquefied oil obtained in the distillation unit 8 is added to the coal pellet shaped mixture under agitation to prepare the coal slurry.

EXAMPLE 1

A coal for general use was liquefied following the method illustrated in FIG. 1. A common COG without treating for hydrogen-enriching was used as the hydrogen source.

A coal for general use (pulverized to −80 mesh 100%, and containing 8.26% ash and 2.75% water on a by dry weight basis) was charged to the slurry tank 2 at a rate of 112 kg/hr. The liquefied oil was added to the tank at a rate of 150 kg/hr. Those components were mixed under agitation to prepare a coal slurry.

The coal slurry was pressurized to 100 atm. COG (having the composition listed in Table 1) pressurized to 100 atm was added to the slurry, then the mixture was heated and sent to the liquefaction reactor 4. COG was further added to the mixture at a rate of 65 $Nm^3$/hr, and the liquefaction reaction was carried out at 430° C. and at a residence time of approximately 20 minutes.

The product of the liquefaction reaction was sent to the gas separator 6 where the used COG and the liquefied slurry were separated from each other. The liquefied slurry was sent to the distillation unit 8 for fractionation.

In the example, COG was used as the hydrogen source. The liquefaction reaction proceeded in a similar manner as in the case that hydrogen was used. From the 166 kg of light oil (liquefied oil) of 166 kg distilled from the distillation unit 8, 16 kg was obtained as the product. The amount of product recovered from the bottom of the distillation unit 8 was 79 kg, which contained 82.7% SRC, 5.9% of dissolved organic matter, and 11.3% ash.

TABLE 1

| $H_2$ | $CH_4$ | $C_2H_4$ | CO | $CO_2$ | $N_2$ |
|---|---|---|---|---|---|
| 56 | 28 | 3 | 7 | 3 | 3 |
| | | | (vol. %) | | |

EXAMPLE 2

A coal was liquefied following the process shown in FIG. 2, where the coal slurry was preheated.

The coal slurry was prepared with the coal for general use employed in Example 1 at a rate of 112 kg/hr. The liquefaction reactor 4 was operated in the similar manner as in Example 1 under the reaction conditions of 430° C., 100 atm, and a residence time of approximately 20 minutes. The heating medium for the heat exchanger was a mixture of diphenyl and diphenylether, which was recycled at a rate of 300 kg/hr.

The reaction product (248 kg/hr) discharged at 430° C. from the reaction tower 4, exchanged heat with the heating medium in the heat exchanger *5b* to raise the temperature of the heating medium to 350° C. The heated heating medium exchanged its heat with the coal slurry (80° C., 262 kg/hr) in the heat exchanger *5a* to raise the temperature of the coal slurry to 280° C. The heating medium which lost the heat and had its temperature reduced to 167° C. was recycled to the heat exchanger *5b*.

The heat recovery conducted in the example reduced the necessary heating temperature range from 350° C. (80° C. to 430° C. in a conventional process) to 150° C. (280° C. to 430° C.). The effect of heat recovery reduced the heat required to raise the coal slurry temperature by 50 to 60% compared with the conventional process.

EXAMPLE 3

A coal for general use was liquefied following the process shown in FIG. 3 using a coal removed its ash in advance.

The coal slurry was prepared in the following procedure for removing the ash therefrom. 330 kg/hr of water was added to 130 kg/hr of a coal for general use (containing 10% ash and 7.6% water on a dry weight base). The mixture was pulverized to obtain the coal-water slurry. The size of pulverized coal was −80 mesh 100%. The coal-water slurry was charged to the ash removal unit 1 where 11 kg/hr the liquefied oil was added to be mixed together and where the mixture was separated into coal components and ash. The mixture of coal components had granules of 1 to 3 mm in size and consisted of 100 kg/hr of coal components, 2 kg/hr of ash, and 10 kg/hr liquefied oil. The residue was a mixture of 10 kg/hr of ash, 8 kg/hr of coal components, 1 kg/hr of liquefied oil, and 337 kg/hr of water.

The mixture of the coal components was charged to the slurry tank 2 to mix with the 140 kg/hr added liquefied oil under agitation to prepare the coal slurry.

The prepared coal slurry was treated by a liquefaction reaction under the same conditions as in Example 1. The reaction product of the liquefaction reaction was introduced to the gas separator 6 to separate it into used COG and liquefied slurry. The liquefied slurry was sent to the distillation facility 8 for distillation.

The process drastically reduced the frequency of cleaning of the process facilities to remove adhered and deposited non-liquefied matter, compared with the frequency in conventional process.

EXAMPLE 4

A COG (composition is given in Table 2) and steam were introduced to the methane conversion unit 20 at a rate of 800 $Nm^3$/hr and 36 kg/hr, respectively to react them under the condition of 20 and, 850° C., in the presence of a catalyst. The gas generated from the reaction had a flow rate of 1550 $Nm^3$/hr and its composition is given in Table 2 (the reacted gas at the first stage).

The reacted gas was introduced to the waste heat boiler to cool it to 400° C., then it was sent to the shift reactor 21 to conduct the second reaction under 20 atm and in the presence of a catalyst. The yielded gas was 1350 $Nm^3$/hr and its composition is given in Table 2 (the reacted gas at the second stage). The reacted gas was cooled to 30° C., and a part of the gas was supplied for the liquefaction reaction. The modified COG used in the liquefaction reaction, when compared the composition excluding water content, increased its hydrogen concentration by approximately 17%. Accordingly, the necessary amount of COG was reduced to approximately 79% compared with the case of non-modified COG application, and the required power for compression COG also reduced to that level.

In addition, the cooling of reacted gas by the waste heat boiler generated steam of 10 kgf/$cm^2$ at a rate of 456 kg/hr.

TABLE 2

| | Coke Oven Gas | First Stage | Second Stage |
|---|---|---|---|
| $H_2$ | 53.6 | 52.6 | 62.0 |
| $CH_4$ | 26.8 | 10.1 | 10.1 |
| $C_2H_4$ | 2.9 | | |
| CO | 7.6 | 11.8 | 2.4 |
| $CO_2$ | 1.9 | 1.9 | 11.3 |
| $N_2$ | 2.9 | 1.5 | 1.5 |
| $H_2O$ | 4.3 | 22.1 | 12.7 |
| | | (vol. %) | |

EXAMPLE 5

The power required to raise the pressure of COG in Example 4 was 119 kw. The gas after the second state reaction was compressed to 100 atm to feed the coal liquefaction reaction step. The consumed power at that compression was 104 kw.

To recover the power from the gas coming from the coal liquefaction reactor, the reacted gas was heated to 150° C. with the steam obtained in Example 4, and a three stage gas expander was employed. The resulted recovered power was 130 kw. The total power recovery rate was 58%. The final gas volume was 1038 $Nm^3$/hr.

According to the invention, a considerably inexpensive COG is used as the hydrogen source for the coal liquefaction reaction, so the production cost of liquefied oil and SRC is significantly reduced. Furthermore, the used COG is introduced to the gas expander, and the pressure energy of COG is recovered as an auxiliary power source of compressor, which saves the power consumption for compressing COG by 50% or more compared with a conventional process and which contributes to the cost reduction.

When the heat of high temperature liquefied oil is recovered by contacting it with a heating medium in a heat exchanger, and when the recovered heat is used to preheat the coal slurry, the required additional heat to heat the coal slurry decreases to approximately 50 to 60% and the heating cost reduces to that amount.

When the ash in coal is removed and when the ash-free coal is introduced to the liquefaction reaction step, the troubles of ash accumulation and adhesion in the process facilities drastically diminish, and the cost accompanied with turn down reduced.

What is claimed is:

1. A method of coal liquefaction comprising:

(a) producing a coal slurry from a pulverized coal and a solvent;

(b) compressing a coke oven gas containing hydrogen to prepare a compressed gas, said coke oven gas being generated during a carbonization of coal in a coke oven;

(c) reacting the coal slurry with the compressed gas in a reactor under a high pressure and a high temperature to form a liquefied product;

(d) separating the liquefied product into a high pressure gas and a liquefied slurry;

(e) distillating the liquefied slurry to form a liquefied oil and a solvent refined coal; and (f) converting the high pressure of the high pressure gas from step (d) into mechanical work for compressing said gas containing hydrogen from step (b).

2. The method of claim 1, wherein said converting of pressure energy to mechanical work is conducted by a gas expander.

3. The method of claim 1, further comprising a step of preheating the coal slurry by exchanging heat between the coal slurry prepared in the step (a) with the liquefied product formed in the step (c).

4. The method of claim 3, wherein a first heat exchanger is disposed upstream of said reactor and a second heat exchanger is disposed downstream of said reactor, said coal slurry from step (a) passing through said first heat exchanger and being heated by a recycled medium, and said liquefied product from step (c) passing through said second heat exchanger to heat said recycled medium.

5. The method of claim 4, wherein said reaction product is at a temperature of 430° C.; said coal slurry enters said first heat exchanger at a temperature of 80° C. and exits from said first heat exchanger at a temperature of 280° C.; said recycled medium exits said second heat exchanger at a temperature of 350° C. and said recycled medium enters said second heat exchanger at a temperature of 167° C.

6. The method of claim 5, wherein said medium is a mixture of diphenyl and diphenylether.

7. The method of claim 1, wherein said producing of said coal slurry comprises:

producing a coal-water slurry by adding water to a pulverized coal;

mixing said liquefied oil with the coal-water slurry and separating the resultant mixture into a first mixture comprising coal components and said liquefied oil and a second mixture comprising ash and water; and adding the liquefied oil to the first mixture comprising coal components and said liquefied oil.

8. The method of claim 1, wherein said coke oven gas is a coke oven gas having an increased content of hydrogen and which is formed by the following steps:

reacting a coke oven gas with steam in the presence of a catalyst to form a reacted gas containing CO; and reacting the CO in the reacted gas with $H_2O$ to form $H_2O$ and $CO_2$.

9. The method of claim 7, wherein said coke oven gas is reacted with said steam at a temperature of 850° C. and at a pressure of 20 atm.

10. The method of claim 1, wherein step (c) is carried out at a temperature of 400° C. or more and at a pressure of 100 atm.

11. The method of claim 10, wherein step (c) is carried out at a temperature of 430° C. for a residence time of 20 minutes.

12. The method of claim 1, wherein said coal slurry from step (a) is heated in a heating furnace prior to introducing the coal slurry into said reactor.

13. The method of claim 12, wherein the method further comprises preheating the coal slurry prior to entering said heating furnace by exchanging heat via a medium, between the liquefied product formed in step (c) and the coal slurry prepared in step (a).

14. The method of claim 13, wherein said coal slurry is produced by adding water to a pulverized coal to form a coal-water slurry; mixing said liquefied oil with the coal-water slurry and separating the resultant mixture into a first mixture comprising coal components and said liquefied oil and a second mixture comprising ash and water; and adding said liquefied oil to said first mixture.

15. The method of claim 14, wherein said coke oven gas is a coke oven gas having an increased content of hydrogen and which is formed by reacting a coke oven gas with steam in the presence of a catalyst to form a reacted gas containing carbon monoxide and reacting the carbon monoxide in the reacted gas with water.

* * * * *

UNITED STATES PATENT AND TRADEMARK OFFICE

CERTIFICATE OF CORRECTION

PATENT NO. : 5,505,839
DATED : April 9, 1996
INVENTOR(S) : Suzuki et al

It is certified that error appears in the above-identified patent and that said Letters Patent is hereby corrected as shown below:

Column 2, line 49: after "for", insert --the--.

Column 5, last line: after "kg/hr", insert --of--.

Column 8, line 29 (Claim 9): "claim 7" should be --claim 8--.

Signed and Sealed this

Twenty-fifth Day of May, 1999

*Attest:*

Q. TODD DICKINSON

*Attesting Officer*

*Acting Commissioner of Patents and Trademarks*